US010856098B1

(12) United States Patent
Robinson et al.

(10) Patent No.: US 10,856,098 B1
(45) Date of Patent: Dec. 1, 2020

(54) DETERMINATION OF AN ACOUSTIC FILTER FOR INCORPORATING LOCAL EFFECTS OF ROOM MODES

(71) Applicant: Facebook Technologies, LLC, Menlo Park, CA (US)

(72) Inventors: Philip Robinson, Seattle, WA (US); Carl Schissler, Redmond, WA (US); Sebastiá Vicenç Amengual Gari, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/418,426

(22) Filed: May 21, 2019

(51) Int. Cl.

| | |
|---|---|
| ***H04R 5/033*** | (2006.01) |
| ***H04R 3/04*** | (2006.01) |
| ***H04R 5/04*** | (2006.01) |
| ***H04S 7/00*** | (2006.01) |
| ***H04S 3/00*** | (2006.01) |

(52) U.S. Cl.
CPC ..... *H04S 7/304* (2013.01); *H04R 3/04* (2013.01); *H04R 5/033* (2013.01); *H04R 5/04* (2013.01); *H04S 3/008* (2013.01); *H04S 2400/01* (2013.01)

(58) Field of Classification Search
CPC ..... H04S 7/304; H04S 3/008; H04S 2400/01; H04R 3/04; H04R 5/033; H04R 5/04
USPC ..... 381/103, 300, 303
See application file for complete search history.

(56) References Cited

U.S. PATENT DOCUMENTS

| | | | | |
|---|---|---|---|---|
| 8,270,620 | B2 * | 9/2012 | Christensen | H04S 7/301 381/300 |
| 9,615,171 | B1 * | 4/2017 | O'Neill | H04R 3/005 |
| 10,440,498 | B1 * | 10/2019 | Amengual Gari | G01H 7/00 |
| 2012/0093320 | A1 | 4/2012 | Flaks et al. | |
| 2015/0208169 | A1 * | 7/2015 | Tawada | H04R 5/04 381/103 |
| 2016/0269828 | A1 * | 9/2016 | Smith | H04R 3/14 |

OTHER PUBLICATIONS m. talbot-smith, Audio engineer's reference book, publication year 1999, Focal Press, 2nd Edition, pp. 2-3 to 2-6.*

(Continued)

*Primary Examiner* — Paul Kim
*Assistant Examiner* — Friedrich Fahnert
(74) *Attorney, Agent, or Firm* — Fenwick & West LLP

(57) ABSTRACT

Determination of an acoustic filter for incorporating local effects of room modes within a target area is presented herein. A model of the target area is determined based in part on a three-dimensional virtual representation of the target area. In some embodiments, the model is selected from a group of candidate models. Room modes of the target area are determined based on a shape and/or dimensions of the model. The room mode parameters are determined based on at least one of the room modes and the position of a user within the target area. The room mode parameters describe an acoustic filter that as applied to audio content, simulates acoustic distortion at the position of the user and at frequencies associated with the at least one room mode. The acoustic filter is generated at a headset based on the room mode parameter and is used to present audio content.

20 Claims, 9 Drawing Sheets

(56) References Cited

OTHER PUBLICATIONS

Amcoustics, "What are room modes?," n.d. [Online] [Retrieved Jun. 14, 2019] Retrieved from the internet <URL: https://amcoustics.com/articles/roommodes>.
MC2 System Design Group, "Room Mode Calculator," n.d. [Online] [Retrieved Jun. 14, 2019] Retrieved from the internet <URL: http://www.mcsquared.com/modecalc.htm>.
Mackensen, P. "Auditive Localization. Head Movements, An Additional Cue in Localization." Dissertation, University of Berlin, Jan. 26, 2004, pp. 1-106.
Mackensen, P. et al. "Head-Tracker Based Auralization Systems: Additional Consideration of Vertical Head Movements." AES 108th Convention, Paris, France, Feb. 19-22, 2000, pp. 1-23.
PCT International Search Report and Written Opinion, PCT Application No. PCT/US2020/028450, dated Jul. 2, 2020, 13 pages.
Walker, B. "A Simple Acoustic Room Model for Virtual Production." Audio: the Second Century—AES UK conference, Jun. 1999, pp. 48-72.

* cited by examiner

Axial Room Mode
210

Tangential Room Mode
220

Oblique Room Mode
230

DETERMINATION OF AN ACOUSTIC FILTER FOR INCORPORATING LOCAL EFFECTS OF ROOM MODES

BACKGROUND

The present disclosure relates generally to presentation of audio, and specifically relates to determination of an acoustic filter for incorporating local effects of room modes.

A physical area (e.g., a room) may have one or more room modes. Room modes are caused by sound reflecting off of various room surfaces. A room mode can cause both antinodes (peaks) and nodes (dips) in a frequency response of the room. The nodes and antinodes of these standing waves result in the loudness of the resonant frequency being different at different locations of the room. Moreover, effects of room modes can be especially prominent in small rooms, such as bathrooms, offices, and small conference rooms. Conventional virtual reality systems fail to account for room modes that would be associated with a particular virtual reality environment. They generally rely on geometrical acoustics simulations that are unreliable at low frequencies or artistic renders unrelated to physical modelling of environment. Accordingly, audio presented by conventional virtual reality systems can lack a sense of realism associated with virtual reality environments (e.g., small rooms).

SUMMARY

Embodiments of the present disclosure support a method, computer readable medium, and apparatus for determining an acoustic filter for incorporating local effects of room modes. In some embodiments, a model of a target area (e.g., a virtual area, a physical environment of the user, etc.) is determined based in part on a three-dimensional (3D) virtual representation of the target area. Room modes of the target area are determined using the model. One or more room mode parameters are determined based on at least one of the room modes and a position of a user within the target area. The one or more room mode parameters describe an acoustic filter. The acoustic filter can be generated based on the one or more room mode parameters. The acoustic filter simulates acoustic distortion at frequencies associated with the at least one room mode. Audio content is presented based in part on the acoustic filter. The audio content is presented such that it appears to originate from an object (e.g., a virtual object) in the target area.

Figure 1:
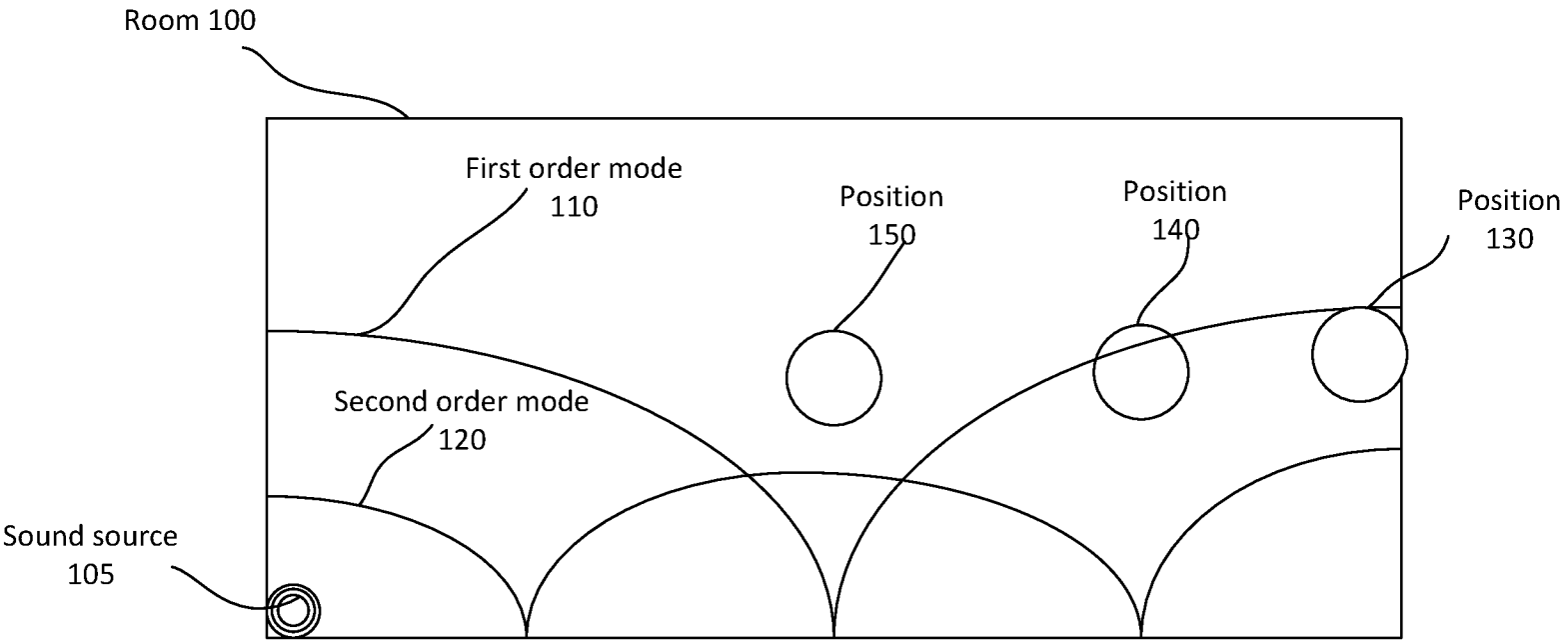
FIG. 1 illustrates local effects of room modes in a room, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset, a head-mounted display (HMD) connected to a host computer system, a standalone HMD, a near-eye display (NED), a mobile device or computing system, or any other hardware platform capable of providing artificial reality content to one or more viewers.

An audio system for determination of an acoustic filter to incorporate local effects of room modes is presented herein. Audio content presented by the audio assembly is filtered using the acoustic filter such that acoustic distortion (e.g., amplification as a function of frequency and position) that would be caused by room modes associated with a target area of the user may be part of the presented audio content. Note that amplification as used herein may be used to describe an increase or a decrease in signal strength. The target area can be a local area occupied by the user or a virtual area. A virtual area may be based on the local area, some other virtual area, or some combination thereof. For example, the local area may be a living room that is occupied by the user of the audio system, and a virtual area may be a virtual concert stadium or a virtual conference room.

The audio system includes an audio assembly communicatively coupled to an audio server. The audio assembly may be implemented on a headset worn by the user. The audio assembly may request (e.g., over a network) one or more room mode parameters from the audio server. The request may include, e.g., visual information (depth information, color information, etc.) of at least a part of the target area, location information of the user, location information of a virtual sound source, visual information of a local area occupied by the user, or some combination thereof.

The audio server determines one or more room mode parameters. The audio server identifies and/or generates a model of the target area using the information in the request. In some embodiments, the audio server develops a 3D virtual representation of at least a portion of the target area based on the visual information of the target area in the request. The audio server uses the 3D virtual representation to select the model from a plurality of candidate models. The audio server determines room modes of the target area by using the model. For example, the audio server determines the room modes based on a shape or dimensions of the model. The room modes may include one or more types of room modes. Types of room modes may include, e.g., axial modes, tangential modes, and oblique modes. For each type, the room modes may include a first order mode, higher order modes, or some combination thereof. The audio server determines the one or more room mode parameters (e.g., Q factor, gain, amplitude, modal frequencies, etc.) based on at least one of the room modes and the position of the user. The audio server may also use the location information of the virtual sound source to determine the room mode parameters. For example, the audio server uses the location information of the virtual sound source to determine whether a room mode is excited or not. The audio server may determine that the room mode is not excited based on that the virtual sound source is located at an antinode position.

The room mode parameters describe an acoustic filter that as applied to the audio content, simulates acoustic distortion at a position of the user within the target area. The acoustic distortion may represent amplification at frequencies associated with the at least one room mode. The audio server transmits one or more of the room mode parameters to the headset.

The audio assembly generates an acoustic filter using the one or more room mode parameters from the audio server. The audio assembly presents audio content using the generated acoustic filter. In some embodiments, the audio assembly dynamically detects changes in the position of the user and/or changes of relative position between the user and virtual objects, and updates the acoustic filter based on the changes.

In some embodiments, the audio content is spatialized audio content. Spatialized audio content is audio content that is presented in a manner such that it appears to originate from one or more points in an environment surrounding the user (e.g., from a virtual object in the target area).

In some embodiments, the target area can be a local area of the user. For example, the target area is an office room where the user sits. As the target area is the actual office, the audio assembly generates an acoustic filter that causes the presented audio content to be spatialized in a manner consistent with how a real sound source would sound from a particular location in the office room.

In some other embodiments, the target area is a virtual area that is being presented to the user (e.g., via a headset). For instance, the target area may be a virtual conference room. As the target area is the virtual conference room, the audio assembly generates an acoustic filter that causes the presented audio content to be spatialized in a manner consistent with how a real sound source would sound from a particular location in the virtual conference room. For example, the user may be presented virtual content that makes it appear as if he/she is seated with a virtual audience watching a virtual speaker give a speech. And the presented audio content as modified by the acoustic filter would make it sound to the user as if the speaker was talking in A conference room—and this is despite the user actually being in the office room (which would have significantly different acoustic properties than a large conference room).

FIG. 1 illustrates local effects of room modes in a room 100, in accordance with one or more embodiments. A sound source 105 is located in the room 100 and emits sound wave into the room 100. The sound wave causes fundamental resonances of the room 100 and room modes occur in the room 100. FIG. 1 shows a first order mode 110 at a first modal frequency of the room and a second order mode 120 at a second modal frequency that is twice of the first modal frequency. Even though not shown in FIG. 1, room modes of higher orders can exist in the room 100. The first order mode 110 and second order mode 120 can both be axial modes.

The room modes depend on the shape, dimensions, and/or acoustic properties of the room 100. Room modes cause different amounts of acoustic distortion at different positions within the room 100. The acoustic distortion can be positive amplification (i.e., increase in amplitude) or negative amplification (i.e., attenuation) of the audio signal at the modal frequencies (and multiples of the modal frequencies).

The first order mode 110 and second order mode 120 have peaks and dips at different positions of the room 100, which cause different levels of amplification of the sound wave as a function of frequency and position within the room 100. FIG. 1 shows three different positions 130, 140, and 150 within the room 100. At the position 130, the first order mode 110 and the second order mode 120 each have a peak. Moving to the position 140, both the first order mode 110 and the second order mode 120 decrease and the second order mode 120 has a dip. Moving further to the position 150, there is a null at the first order mode 110 and a peak at the second order mode 120. Combining the effects of the first order mode 110 and second order mode 120, the amplification of the audio signal is the highest at the position 130 and lowest at the position 150. Accordingly, sound perceived by a user can vary dramatically based on what room they are in and where they are in the room. As described below, a system is described which simulates room modes for a target area occupied by a user, presents audio content to the user taking into account the room modes to provide an added level of realism to the user.

Figure 2:
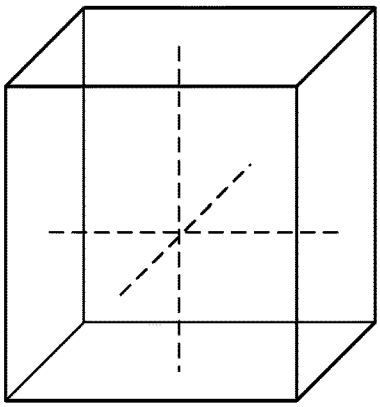
FIG. 2 illustrates axial modes, tangential modes, and oblique modes of a cube room, in accordance with one or more embodiments.
Figure 2:
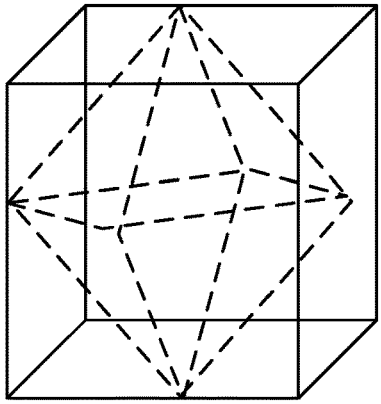
Figure 2:
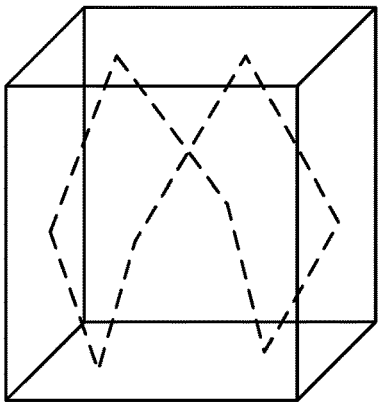

FIG. 2 illustrates axial modes 210, tangential modes 220, and oblique modes 230 of a cube room, in accordance with one or more embodiments. Room modes are caused by sound reflecting off of various room surfaces. The room in FIG. 2 has a shape of a cube and includes six surfaces: four walls, a ceiling, and a floor. There are three types of modes in the room: the axial modes 210, tangential modes 220, and oblique modes 230, which are represented by dash lines in FIG. 2. An axial mode 210 involves resonance between two parallel surfaces of the room. Three axial modes 210 occur in the room: one involves the ceiling and the floor, and the other two each involve a pair of parallel walls. For rooms of other shapes, different numbers of axial modes 210 may occur. A tangential mode 220 involves two sets of parallel surfaces, all four walls or two walls with the ceiling and the floor. An oblique room mode 230 involves all the six surfaces of the room.

The axial room modes 210 are the strongest out of the three types of modes. The tangential room modes 220 can be half as strong as the axial room modes 210, and the oblique room modes 230 can be one quarter as strong as the axial room modes 210. In some embodiments, an acoustic filter that as applied to audio content, simulates acoustic distortion in the room is determined based on the axial room modes 210. In some other embodiments, the tangential room modes 220 and/or oblique room modes 230 are also used to determine the acoustic filter. Each of the axial room modes 210, tangential room modes 220, and oblique room modes 230 can occur at a series of modal frequencies. The modal frequencies of the three types of room modes can be different.

Figure 3:
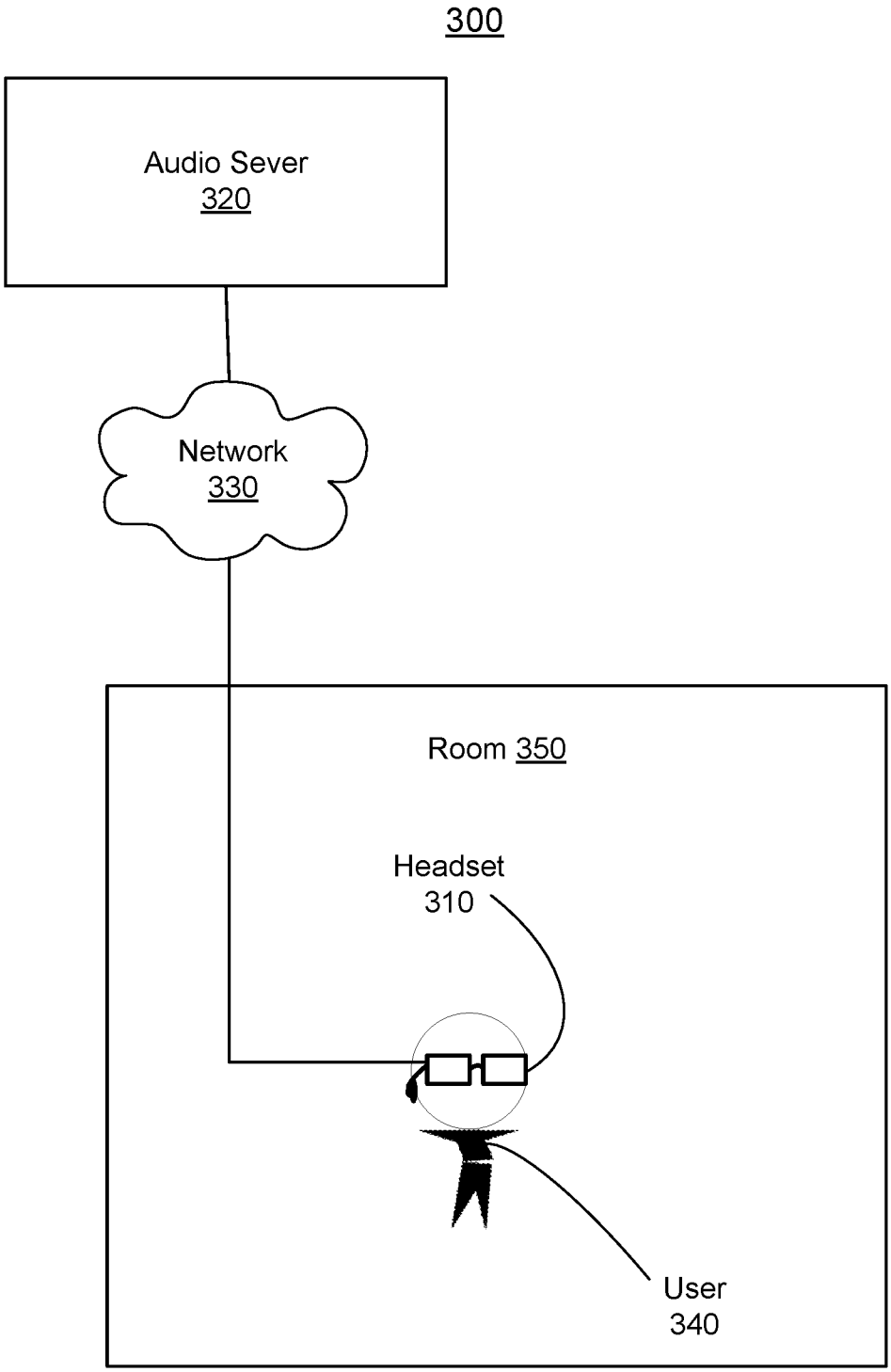
FIG. 3 is a block diagram of an audio system, in accordance with one or more embodiments.

FIG. 3 is a block diagram of an audio system 300, in accordance with one or more embodiments. The audio system 300 includes a headset 310 is connected to an audio server 320 via a network 330. The headset 310 can be worn by a user 340 in a room 350.

The network 330 connects the headset 310 to the audio server 320. The network 330 may include any combination of target area and/or wide area networks using both wireless and/or wired communication systems. For example, the network 330 may include the Internet, as well as mobile telephone networks. In one embodiment, the network 330 uses standard communications technologies and/or protocols. Hence, the network 330 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 330 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 330 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc. The network 330 may also connect multiple headsets located in the same or different rooms to the same audio server 320.

The headset 310 presents media content to a user. In one embodiment, the headset 310 may be, e.g., a NED or a HMD. In general, the headset 310 may be worn on the face of a user such that media content is presented using one or both lenses of the headset 310. However, the headset 310 may also be used such that media content is presented to a user in a different manner. Examples of media content presented by the headset 310 include one or more images, video content, audio content, or some combination thereof. The headset 310 includes an audio assembly, and may also include at least one depth camera assembly (DCA) and/or at least one passive camera assembly (PCA). As described in detail below with regard to FIG. 8, a DCA generates depth image data that describes the 3D geometry for some or all of the target area (e.g., the room 350), and a PCA generates color image data for some or all of the target area. In some embodiments, the DCA and the PCA of the headset 310 are part of simultaneous localization and mapping (SLAM) sensors mounted on the headset 310 for determining visual information of the room 350. Thus, the depth image data captured by the at least one DCA and/or the color image data captured by the at least one PCA can be referred to as visual information determined by the SLAM sensors of the headset 310. Furthermore, the headset 310 may include position sensors or an inertial measurement unit (IMU) that tracks the position (e.g., location and pose) of the headset 310 within the target area. The headset 310 may also include a Global Positioning System (GPS) receiver to further track location of the headset 310 within the target area. The position (includes orientation) of the of the headset 310 within the target area is referred to as location information of the headset 310. The location information of the headset may indicate a position of the user 340 of the headset 310.

The audio assembly presents audio content to the user 340. The audio content can be presented in a manner such that it appears to originate from an object (real or object) in the target area, also known as spatialized audio content. The target area can be a physical environment of the user, such as the room 350, or a virtual area. For example, the audio content presented by the audio assembly may appear to originate from a virtual speaker in a virtual conference room (which are being presented to the user 340 via the headset 310). In some embodiments, local effects of room modes associated with a position of the user 340 within a target area are incorporated into the audio content. The local effects of the room modes are represented by acoustic distortion (of specific frequencies) that occurs at a position of the user 340 within the target area. The acoustic distortion may change as the position of the users in the target area changes. In some embodiments, the target area is the room 350. In some other embodiments, the target area is a virtual area. The virtual area may be based on a real room that is different from the room 350. For instance, the room 350 is an office. The target area is a virtual area based on a conference room. The audio content presented by the audio assembly can be a speech from a speaker located in the conference room. A position within the conference room corresponds to the user's position within the target area. The audio content is rendered so that it appears originating from the speaker of the conference room and being received at the position within the conference room.

The audio assembly uses acoustic filters to incorporate the local effects of room modes. The audio assembly requests an acoustic filter by sending a room mode query to the audio server 320. A room mode query is a request for one or more room mode parameters, based on which the audio assembly can generate an acoustic filter that as applied to the audio content simulates acoustic distortion (e.g., amplification as a function of frequency and position) that would be caused by the room modes. The room mode query may include visual information describing some or all of the target area (e.g., the room 350 or a virtual area), location information of the user, information of the audio content, or some combination thereof. Visual information describes a 3D geometry of some or all of the target area and may also include color image data of some or all of the target area. In some embodiments, the visual information of the target area can be captured by the headset 310 (e.g., in embodiments where the target area is the room 350) and/or a different device. Location information of the user indicates a position of the user 340 within the target area and may include location information of the headset 310 or information describing a position of the user 340. Information of the audio content includes, e.g., information describing a location of a virtual sound source of the audio content. The virtual sound source of the audio content can be a real object in the target area and/or a virtual object. The headset 310 may communicate the room mode query via the network 330 to the audio server 320.

In some embodiments, the headset 310 obtains one or more room mode parameters describing an acoustic filter from the audio server 320. Room mode parameters are parameters that describe an acoustic filter that as applied to audio content simulates acoustic distortion caused by one or more room modes in a target area. The room mode parameters include Q factor, gain, amplitude, modal frequencies of the room modes, some other feature that describes an acoustic filter, or some combination thereof. The headset 310 uses the room modes parameters to generate filters to render the audio content. For example, the headset 310 generates infinite impulse response filters and/or all-pass filters. The infinite impulse response filters and/or all-pass filters include a Q value and gain corresponding to each modal frequency. Additional details regarding operations and components of the headset 310 are discussed below in connection with FIG. 4, FIG. 8, and FIG. 9.

The audio server 320 determines one or more room mode parameters based on the room mode query received from the headset 310. The audio server 320 determines a model of the target area. In some embodiments, the audio server 320 determines the model based on the visual information of the target area. For example, the audio server 320 obtains a 3D virtual representation of at least a portion of the target area based on the visual information. The audio server 320 compares the 3D virtual representation with a group of candidate models and identifies a candidate model that matches the 3D virtual representation as the model. In some embodiments, a candidate model is a model of a room that includes a shape of the room, one or more dimensions of the room, or material acoustic parameters (e.g., attenuation parameter) of surfaces within the room. The group of candidate models can include models of rooms having different shapes, different dimensions, and different surfaces. The 3D virtual representation of the target area includes a 3D mesh of the target area that defines a shape and/or dimensions of the target area. The 3D virtual representation may use one or more material acoustic parameters (e.g., attenuation parameter) to describe acoustic properties of surfaces within the target area. The audio server 320 determines that a candidate model matches the 3D virtual representation based on a determination that a difference between the candidate model and the 3D virtual representation is below a threshold. The difference may include difference in shapes, dimensions, acoustic properties of surfaces, etc. In some embodiments, the audio server 320 uses a fit metric to determine the difference between the candidate model and the 3D virtual representation. The fit metric can be based on one or more geometric features, such as square errors in Hausdorff distance, openness (e.g. indoors vs outdoors), volume, etc. The threshold may be based on perceptual just noticeable differences (JNDs) in room mode changes. For example, if the user can detect a 10% change in modal frequency, geometric deviations that would result in a modal frequency change of up to 10% would be tolerated. The threshold can be the geometric deviations that would result in a modal frequency change of 10%.

The audio server 320 determines room modes of the target area using the model. For example, the audio server 320 uses conventional techniques, such as numerical simulation techniques (e.g., finite element method, boundary element method, finite difference time domain method, etc.), to determine the room modes. In some embodiments, the audio server 300 determines the room modes based on the shape, dimensions, and/or material acoustic parameters of the model to determine the room modes. The room modes may include one or more of axial modes, tangential modes, and oblique modes. In some embodiments, the audio server 320 determines the room modes based on the position of the user. For example, the audio server 320 identifies the target area based on the position of the user and retrieves the room modes of the target area based on the identification.

The audio server 330 determines the one or more room mode parameters based on at least on one of the room modes and the position of a user within the target area. The room mode parameters describe an acoustic filter that as applied to the audio content, simulates acoustic distortion that occurs at the position of the user within the target area for frequencies associated with the at least one room mode. The audio server 320 transmits the room mode parameters to the headset 310 for rendering audio content. In some embodiments, the audio server 330 may generate the acoustic filter based on the room mode parameters and transmits the acoustic filter to the headset 310.

Figure 4:
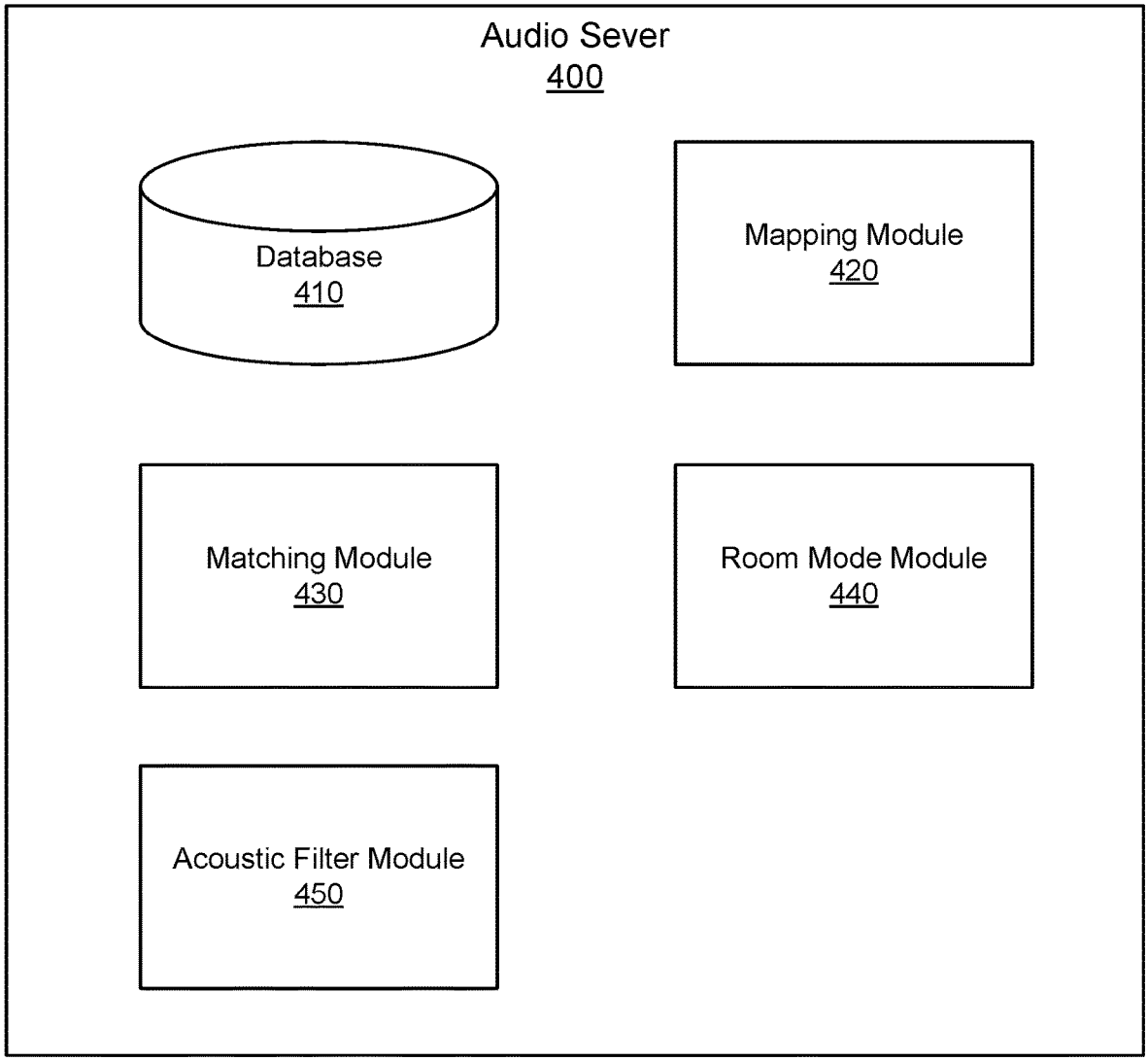
FIG. 4 is a block diagram of an audio server, in accordance with one or more embodiments.

FIG. 4 is a block diagram of an audio server 400, in accordance with one or more embodiments. An embodiment of the audio server 400 is the audio server 300. The audio server 400 determines one or more room mode parameters of a target area in response to a room mode query from an audio assembly. The audio server 400 includes a database 410, a mapping module 420, a matching module 430, a room mode module 440, and an acoustic filter module 450. In other embodiments, the audio server 400 can have any combination of the modules listed with any additional modules. One or more processors of the audio server 400 (not shown) may run some or all of the modules within the audio server 400.

The database 410 stores data for the audio server 400. The stored data may include a virtual model, candidate models, room modes, room mode parameters, acoustic filters, audio data, visual information (depth information, color information, etc.), room mode queries, other information that may be used by the audio server 400, or some combination thereof.

The virtual model describes one or more areas and acoustic properties (e.g., room modes) of those areas. Each location in the virtual model is associated with acoustic properties (e.g., room modes) for a corresponding area. The areas whose acoustic properties are described in the virtual model include virtual areas, physical areas, or some combination thereof. A physical area is a real area (e.g., an actual physical room), as opposed to a virtual area. Examples of the physical areas include a conference room, a bathroom, a hallway, an office, a bedroom, a dining room, an outdoor space (e.g., patio, garden, park, etc.), a living room, an auditorium, some other real area, or some combination thereof. A virtual area describes a space that may be entirely fictional and/or based on a real physical area (e.g., rendering a physical room as a virtual area). For example, a virtual area could be a fictionalized dungeon, a rendering of a virtual conference room, etc. Note that the virtual area can be based on real places. For example, the virtual conference room could be based on a real conference center. A particular location in the virtual model may correspond to a current physical location of the headset 310 within the room 350. Acoustic properties of the room 350 can be retrieved from the virtual model based on a location within the virtual model obtained from the mapping module 420.

A room mode query is a request for room mode parameters that describes an acoustic filter used for incorporating effects of room modes of a target area for a position of a user within the target area. The room mode query includes target area information, user information, audio content information, some other information that the audio server 320 can use to determine the acoustic filter, or some combination thereof. Target area information is information that describes the target area (e.g., its geometry, objects within it, materials, colors, etc.). It may include depth image data of the target area, color image data of the target area, or some combination thereof. User information is information that describes the user. It may include information describing a position of the user within the target area, information of a physical area where the user is physically located, or some combination thereof. Audio content information is information that describes the audio content. It may include location information of a virtual sound source of the audio content, location information of a physical sound source of the audio content, or some combination thereof.

The candidate models can be models of rooms having different shapes and/or dimensions. The audio server 400 uses the candidate models to determine a model of the target area.

The mapping module 420 maps information in the room mode query to a location within the virtual model. The mapping module 420 determines the location within the virtual model corresponding to the target area. In some embodiments, the mapping module 420 searches the virtual model to identify a mapping between (i) the information of the target area and/or information of the position of the user and (ii) a corresponding configuration of an area within the virtual model. The area within the virtual model may describe a physical area and/or virtual area. In one embodiment, the mapping is performed by matching a geometry of visual information of the target area with a geometry associated with a location within the virtual model. In another embodiment, the mapping is performed by matching information of the position of the user with a location within the virtual model. For example, in embodiments where the target area is a virtual area, the mapping module 420 identifies a location associated with the virtual area in the virtual model based on information indicating the position of the user. A match suggests that the location within the virtual model is a representation of the target area.

If a match is found, the mapping module 420 retrieves the room modes that are associated with the location within the virtual model and sends the room modes to the acoustic filter module 450 for determining room mode parameters. In some embodiments, the virtual model does not include room modes associated with the location within the virtual model that matches the target area but includes a candidate model associated with the location. The mapping module 420 may retrieve the candidate model and sends it to the room mode module 440 to determine room modes of the target area. In some embodiments, the virtual model does not include room modes or candidate models associated with the location within the virtual model that matches the target area. The mapping module 420 may retrieve a 3D representation of the location and sends it to the matching module 440 to determine a model of the target area.

If no match is found, this is an indication that a configuration of the target area is not yet described by the virtual model. In such case, the mapping module 420 may develop a 3D virtual representation of the target area based on the visual information in the room mode query and update the virtual model with the 3D virtual representation. The 3D virtual representation of the target area may include a 3D mesh of the target area. The 3D mesh includes points and/or lines that represent boundaries of the target area. The 3D virtual representation may also include virtual representation of surfaces within the target area, such as walls, ceiling, floor, surfaces of furniture, surfaces of appliances, surfaces of other types of objects, and so on. In some embodiments, the virtual model uses one or more material acoustic parameters (e.g., attenuation parameter) to describe acoustic properties of the surfaces within the virtual area. In some embodiments, the mapping module 420 may develop a new model that includes the 3D virtual representation and uses one or more material acoustic parameters to describe acoustic properties of the surfaces within the virtual area. The new model can be saved in the database 410.

The mapping module 420 may also inform at least one of the matching module 430 and the room mode module 440 that no match is found, so that the matching module 430 can determine a model of the target area and the room mode module 440 can determine room modes of the target area by using the model.

In some embodiments, the mapping module 420 may also determine a location within the virtual model corresponding to a local area where the user is physically located (e.g., the room 350).

The target area may be different from the local area. For example, the local area is an office room where the user sits, but the target area is a virtual area (e.g., a virtual conference room).

If a match is found, the mapping module 420 retrieves the room modes that are associated with the location within the virtual model corresponding to the target area and sends the room modes to the acoustic filter module 450 for determining room mode parameters. If no match is found, the mapping module 420 may develop a 3D virtual representation of the target area based on the visual information in the room mode query and update the virtual model with the 3D virtual representation of the target area. The mapping module 420 may also inform at least one of the matching module 430 and the room mode module 440 that no match is found, so that the matching module 430 can determine a model of the target area and the room mode module 440 can determine room modes of the target area by using the model.

The matching module 430 determines a model of the target area based on the 3D virtual representation of the target area. Taking the target area as an example, in some embodiments, the matching module 430 selects the model from a plurality of candidate models. A candidate model can be a model of a room that includes information about shape, dimensions, or surfaces within the room. The group of candidate models can include models of rooms having different shapes (e.g., square, round, triangle, etc.), different dimensions (e.g., shoebox, big conference room, etc.), and different surfaces. The matching module 430 compares the 3D virtual representation of the target area with each candidate model and determines whether the candidate model matches the 3D virtual representation. The matching module 430 determines that a candidate model matches the 3D virtual representation based on a determination that a difference between the candidate model and the 3D virtual representation is below a threshold. The difference may include difference in shapes, dimensions, acoustic properties of surfaces, etc. In some embodiments, the matching module 430 may determine that the 3D virtual representation matches multiple candidate models. The matching module 430 selects the candidate model with the best match, i.e., the candidate model having the least difference from the 3D virtual representation.

In some embodiments, the matching module 430 compares the shape of a candidate model and the shape of the 3D mesh included in the 3D virtual representation. For example, the matching module 430 traces rays in a number of directions from a center of the 3D mesh target area and determines points where the rays intersect with the 3D mesh computes. The matching module 430 identifies a candidate model that matches these points. The matching module 430 may shrink or expand the candidate model to exclude any differences in sizes of the candidate model and the target area from the comparison.

The room mode module 440 determines room modes of the target area using the model of the target area. The room modes may include at least one of three types of room mode: axial modes, tangential modes, and oblique modes. In some embodiments, for each type of room mode, the room mode module 440 determines a first order mode and may also determine modes of higher orders. The room mode module 440 determines the room modes based on the shape and/or dimensions of the model. For example, in embodiments where the model has a rectangular homogeneous shape, the room mode module 440 determines axial, tangential, and oblique modes of the model. In some embodiments, the room mode module 440 uses the dimensions of the model to calculate room modes that fall within a range from a lower frequency in an audile or reproducible frequency range (e.g., 63 Hz) to a Schroeder frequency of the target area. The Schroeder frequency of the target area can be a frequency at which room modes are too densely overlapped in frequency to be individually distinguishable. The room mode module 440 may determine the Schroeder frequency based on a volume of the target area and a reverberation time (e.g., RT60) of the target area. The room mode module 440 may use e.g., numerical simulation techniques (such as finite element method, boundary element method, finite difference time domain method, etc.), to determine the room modes.

In some embodiments, the room mode module 440 uses material acoustic parameters (such as attenuation parameter) of surfaces within the 3D virtual representation of the target area to determine the room modes. For example, the room mode module 440 determines material composition of the surfaces using the color image data the target area. The room mode module 440 determines an attenuation parameter for each surface based on the material composition of the surface and updates the model with the material compositions and attenuation parameters.

In one embodiment, the room mode module 440 uses machine learning techniques to determine the material composition of the surfaces. The initialization module 230 can input image data of the target area (or a part of the image data that is related to the surface) and/or audio data into a machine learning model, the machine learning model outputs the material composition of each surface. The machine learning model can be trained with different machine learning techniques, such as linear support vector machine (linear SVM), boosting for other algorithms (e.g., AdaBoost), neural networks, logistic regression, naïve Bayes, memory-based learning, random forests, bagged trees, decision trees, boosted trees, or boosted stumps. As part of the training of the machine learning model, a training set is formed. The training set includes image data and/or audio data of a group of surfaces and material composition of the surfaces in the group.

For each room mode or a combination of multiple room modes, the room mode module 440 determines amplification as a function of frequency and position. The amplification includes increase or decrease in signal strength caused by the corresponding room mode(s).

The acoustic filter module 450 determines one or more room mode parameters of the target area based on at least one of the room modes and the position of the user within the target area. In some embodiments, the acoustic filter module 450 determines the room mode parameters based on amplification as a function of frequency and position (e.g., position of the user) within the target area. The room mode parameters describes acoustic distortion caused by the at least one of room modes at the position of the user. In some embodiments, the acoustic filter module 450 also uses the position of a sound source of the audio content to determine the acoustic distortion.

In some embodiments, the audio content is rendered by one or more speakers that are external to the headset. The acoustic filter module 450 determines one or more room mode parameters of a local area of the user. In some embodiments, the target area is different from the local area. For instance, the local area of the user is an office room where the user sits, and the target area is a virtual conference room including a virtual sound source (e.g., a speaker). The room mode parameters of the local area describe an acoustic filter of the local area that can be used to render audio content from a speaker external to the headset (e.g., on or coupled to a console). The acoustic filter of the local area mitigates room modes of the local area at the position of the user in the local area. In some embodiments, the acoustic filter module 450 determines the room modes parameters of the local area based on one or more room modes of the local area determined by the room mode module 440. The room modes of the local area can be determined based on a model of the local area determined by either the mapping module 420 or the matching module 430.

Figure 5:
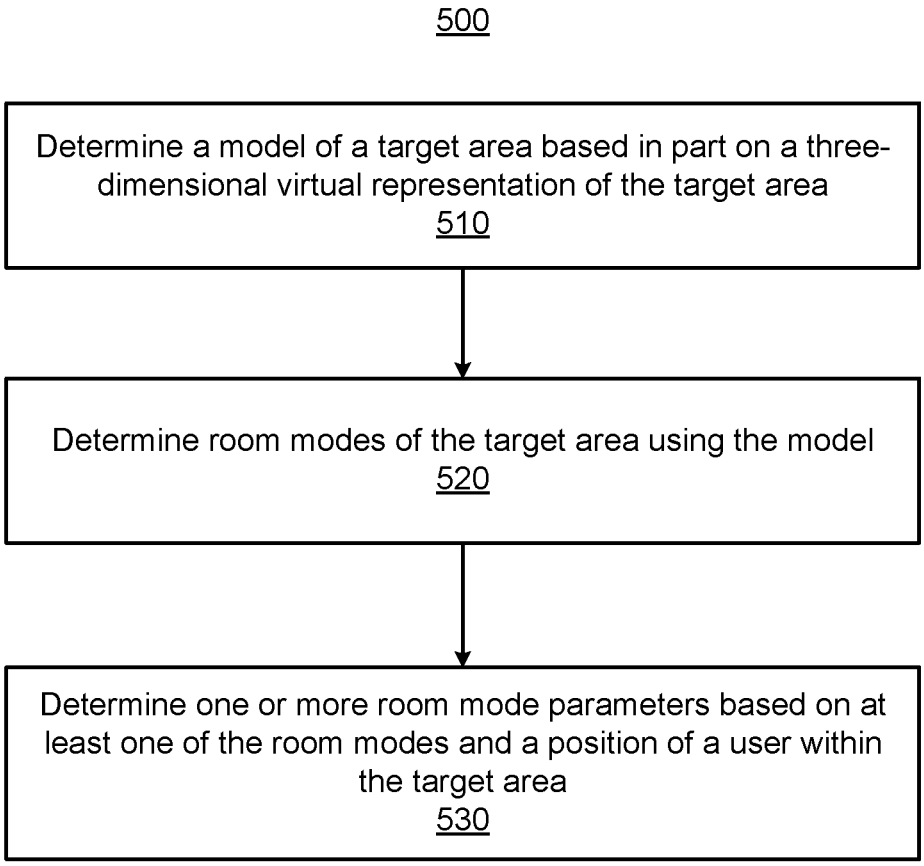
FIG. 5 is a flowchart illustrating a process for determining room mode parameters that describe an acoustic filter, in accordance with one or more embodiments.

FIG. 5 is a flowchart illustrating a process 500 for determining room mode parameters that describe an acoustic filter, in accordance with one or more embodiments. The process 500 of FIG. 5 may be performed by the components of an apparatus, e.g., the audio server 400 of FIG. 4. Other entities (e.g., portions of a headset and/or console) may perform some or all of the steps of the process in other embodiments. Likewise, embodiments may include different and/or additional steps, or perform the steps in different orders.

The audio server 400 determines 510 a model of a target area based in part on a 3D virtual representation of the target area. The target area can be a local area or a virtual area. The virtual area may be based on a real room. In some embodiments, the audio server 510 determines the model by retrieving the model from a database based on a position of a user within the target area. For example, the database stores a virtual model that describes one or more areas and includes models of those areas. Each area corresponds to a location within the virtual model. The areas include virtual areas, physical areas, or some combination thereof. The audio server 400 can identify a location associated with the target area in the virtual model, e.g., based on the position of the user within the target area. The audio server 400 retrieves the model associated with the identified location. In other some embodiments, the audio server 400 receives, e.g., from a headset, depth information describing at least a portion of the target area. In some embodiments, the audio server 400 generates at least a part of the 3D virtual representation using the depth information. The audio server 400 compares the 3D virtual representation with a plurality of candidate models. The audio server 400 identifies one of the plurality of candidate models that match the three-dimensional virtual representation as the model of the target area. In some embodiments, the audio server 400 determines that a candidate model matches the three-dimensional virtual representation based on a determination that a difference between the shape of the candidate model and the 3D virtual representation is below a threshold. The audio server 400 may shrink or expand the candidate model during comparison to eliminate any differences in dimensions of the candidate model and the 3D virtual representation. In some embodiments, the audio server 400 determines an attenuation parameter for each surface in the 3D virtual representation and updates the model with the attenuation parameter.

The audio server 400 determines 520 room modes of the target area using the model. In some embodiments, the audio server 320 determines the room modes based on a shape of the model. Room modes may be calculated using conventional techniques. The audio server 400 can also use dimensions of the model and/or attenuation parameters of the surfaces in the 3D virtual representation to determine the room modes. The room modes may include axial modes, tangential modes, or oblique modes. In some embodiments, the room modes fall within a range from a lower frequency of the audible frequency range (e.g., 63 Hz) to a Schroeder frequency of the target area. The room modes describe amplification of sounds at specific frequencies as a function of position within the target area. The audio server 400 may determine amplification corresponding to a combination of multiple room modes.

The audio server 400 determines 530 one or more room mode parameters (e.g., Q factor, etc.) based on at least one of the room modes and a position of a user within the target area. A room mode is represented by amplification of signal strength as a function of frequency and position. In some embodiments, the audio server 400 combines the amplification associated with more than one room modes to more fully describe amplification as a function of frequency and position. The audio server 400 determines amplification as a function of frequency at the position of the user. Based on the function of the amplification and frequency at the position of the user, the audio server 400 determines the room mode parameters. The room mode parameters describe an acoustic filter that as applied to audio content, simulates acoustic distortion at the position of the user at frequencies associated with the at least one room mode. In some embodiments, the at least one room mode is a first order axial mode. In some embodiments, the audio server 320 determines the one or more room mode parameters based on amplification corresponding to the at least one room mode at the position of the user within the target area. The acoustic filter can be used by a headset to present audio content to the user.

Figure 6:
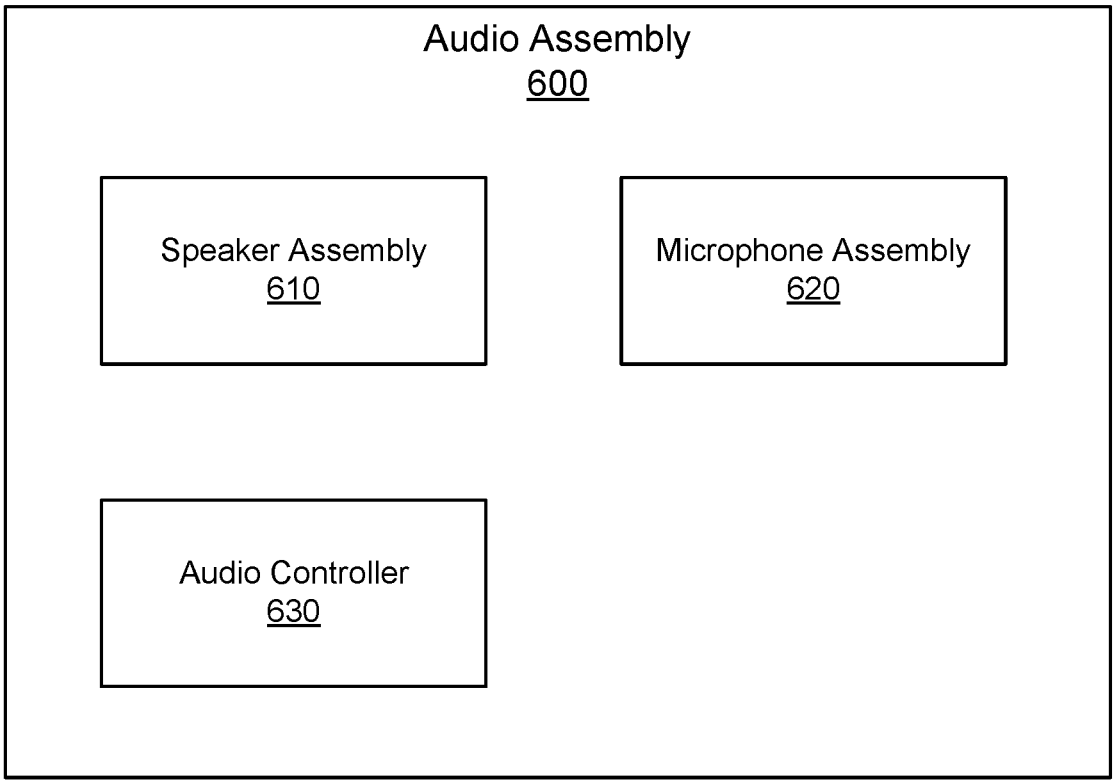
FIG. 6 is a block diagram of an audio assembly, in accordance with one or more embodiments.

FIG. 6 is a block diagram of an audio assembly 600, in accordance with one or more embodiments. Some or all of the audio assembly 600 may be part of a headset (e.g., the headset 310). The audio assembly 600 includes a speaker assembly 610, a microphone assembly 620, and an audio controller 630. In one embodiment, the audio assembly 600 further comprises an input interface (not shown in FIG. 6) for, e.g., controlling operations of different components of the audio assembly 600. In other embodiments, the audio assembly 600 can have any combination of the components listed with any additional components. In some embodiments, one or more of the functions of the audio server 400 may be performed by the audio assembly 600.

The speaker assembly 610 produces sound for user's ears, e.g., based on audio instructions from the audio controller 630. In some embodiments, the speaker assembly 610 is implemented as pair of air conduction transducers (e.g., one for each ear) that produce sound by generating an airborne acoustic pressure wave in the user's ears, e.g., in accordance with the audio instructions from the audio controller 630. Each air conduction transducer of the speaker assembly 610 may include one or more transducers to cover different parts of a frequency range. For example, a piezoelectric transducer may be used to cover a first part of a frequency range and a moving coil transducer may be used to cover a second part of a frequency range. In some other embodiments, each transducer of the speaker assembly 610 is implemented as a bone conduction transducer that produces sound by vibrating a corresponding bone in the user's head. Each transducer implemented as a bone conduction transducer may be placed behind an auricle coupled to a portion of the user's bone to vibrate the portion of the user's bone that generates a tissue-borne acoustic pressure wave propagating toward the user's cochlea, thereby bypassing the eardrum. In some other embodiments, each transducer of the speaker assembly 610 is implemented as a cartilage conduction transducer that produces sound by vibrating one or more portions of the auricular cartilage around the outer ear (e.g., the pinna, the tragus, some other portion of the auricular cartilage, or some combination thereof). The cartilage conduction transducer generates airborne acoustic pressure waves by vibrating the one or more portions of the auricular cartilage.

The microphone assembly 620 detects sound from the target area. The microphone assembly 620 may include a plurality of microphones. The plurality of microphones may include, e.g., at least one microphone configured to measure sound at an entrance of an ear canal for each ear, one or more microphones positioned to capture sound from the target area, one or more microphones positioned to capture sound from the user (e.g., user speech), or some combination thereof.

The audio controller 630 generates a room mode query to request for room mode parameters. The audio controller 630 can generate the room mode query based at least in part on visual information of the target area and location information of the user. The audio controller 630 may obtain the visual information of the target area, e.g., from one or more cameras of the headset 310. The visual information describes 3D geometry of the target area. The visual information may include depth image data, color image data, or combination thereof. The depth image data may include geometry information about a shape of the target area defined by surfaces of the target area, such as surfaces of the walls, floor and ceiling of the target area. The color image data may include information about acoustic materials associated with surfaces of the target area. The audio controller 630 may obtain the location information of the user from the headset 310. In one embodiments, the location information of the user includes location information of the headset. In another embodiment, the local information of the user specifies a position of the user in a real room or a virtual room.

The audio controller 630 generates an acoustic filter based on room mode parameters received from the audio server 400 and provides audio instructions to the speaker assembly 610 to present audio content using the acoustic filter. For example, the audio controller 630 generates bell-shaped parametric infinite impulse response filters based on the room mode parameters. The bell-shaped parametric infinite impulse response filters include a Q value and gain corresponding to each modal frequency. In some embodiments, the audio controller 630 applies these filters to render the audio signal, e.g., by increasing amplitude of the audio signal at the modal frequencies. In some embodiments, audio controller 630 places these filters within a feedback loop of an artificial reverberator (e.g., Schroeder, FDN, or nested all-pass reverberator) or to modify the reverberation time at the modal frequencies. The audio controller 630 applies the acoustic filter to the audio content such that acoustic distortion (e.g., amplification as a function of frequency and position) that would be caused by room modes associated with the target area of the user may be part of the presented audio content.

As another example, the audio controller 630 generates all-pass filters based on the room mode parameters. The all-pass filters have Q value centered at the modal frequencies. The audio controller 630 uses the all-pass filters to delay the audio signal at the modal frequencies and to create a perception of ringing at the modal frequencies. In some embodiments, the audio controller 630 uses both the bell-shaped parametric infinite impulse response filters and the all-pass filters to render the audio signal. In some embodiments, the audio controller 630 dynamically updates the filters based on changes in the position of the user.

Figure 7:
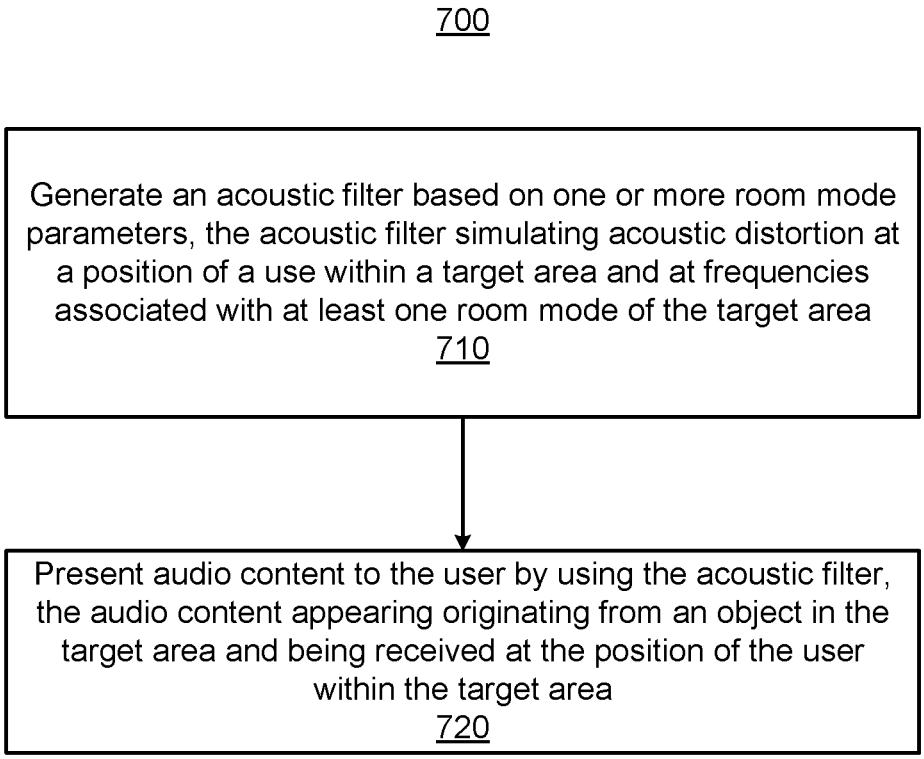
FIG. 7 is a flowchart illustrating a process of presenting audio content based in part on an acoustic filter, in accordance with one or more embodiments.

FIG. 7 is a flowchart illustrating a process 700 of presenting audio content by using an acoustic filter, in accordance with one or more embodiments. The process 700 of FIG. 7 may be performed by the components of an apparatus, e.g., the audio assembly 600 of FIG. 6. Other entities (e.g., components of the headset 900 of FIG. 9 and/or components shown in FIG. 8) may perform some or all of the steps of the process in other embodiments. Likewise, embodiments may include different and/or additional steps, or perform the steps in different orders.

The audio assembly 600 generates 710 an acoustic filter based on one or more room mode parameters. The acoustic filter, as applied to content, simulates acoustic distortion at a position of the user within a target area and at frequencies associated with at least one room mode of the target area. The acoustic distortion is represented by amplification at a position of a user within the target area when a sound is emitted in the target area. The target area can be a local area of the user or a virtual area. In some embodiments, the acoustic filter includes infinite impulse response filters with Q value and gain at modal frequencies of the room mode and/or all-pass filter with Q value centered at the modal frequencies.

In some embodiments, the one or more room mode parameters are received by the audio assembly 600 from an audio server, e.g., the audio server 400. The audio assembly sends a room mode query to the audio server and the audio server determines the one or more room mode parameters based on information in the room mode query. In some other embodiments, the audio assembly 600 determines the one or more room mode parameters based on the at least one room mode of the target area. The at least one room mode of the target area can be determined by the audio server and sent to the audio assembly 600.

The audio assembly 600 presents 720 audio content to the user by using the acoustic filter. For example, the audio assembly 600 applies the acoustic filter to the audio content such that acoustic distortion (e.g., increase or a decrease in signal strength) that would be caused by room modes associated with a target area of the user may be part of the presented audio content. The audio content appears originating from an object in the target area and being received at the position of the user within the target area, even though the user may not be physically located in the target area. For instance, the user sits in an office room and the audio content (e.g., a musical) can be presented to appear originating from a speaker in a virtual conference room and being received at a position of the user in the virtual conference room.

System Environment

Figure 8:
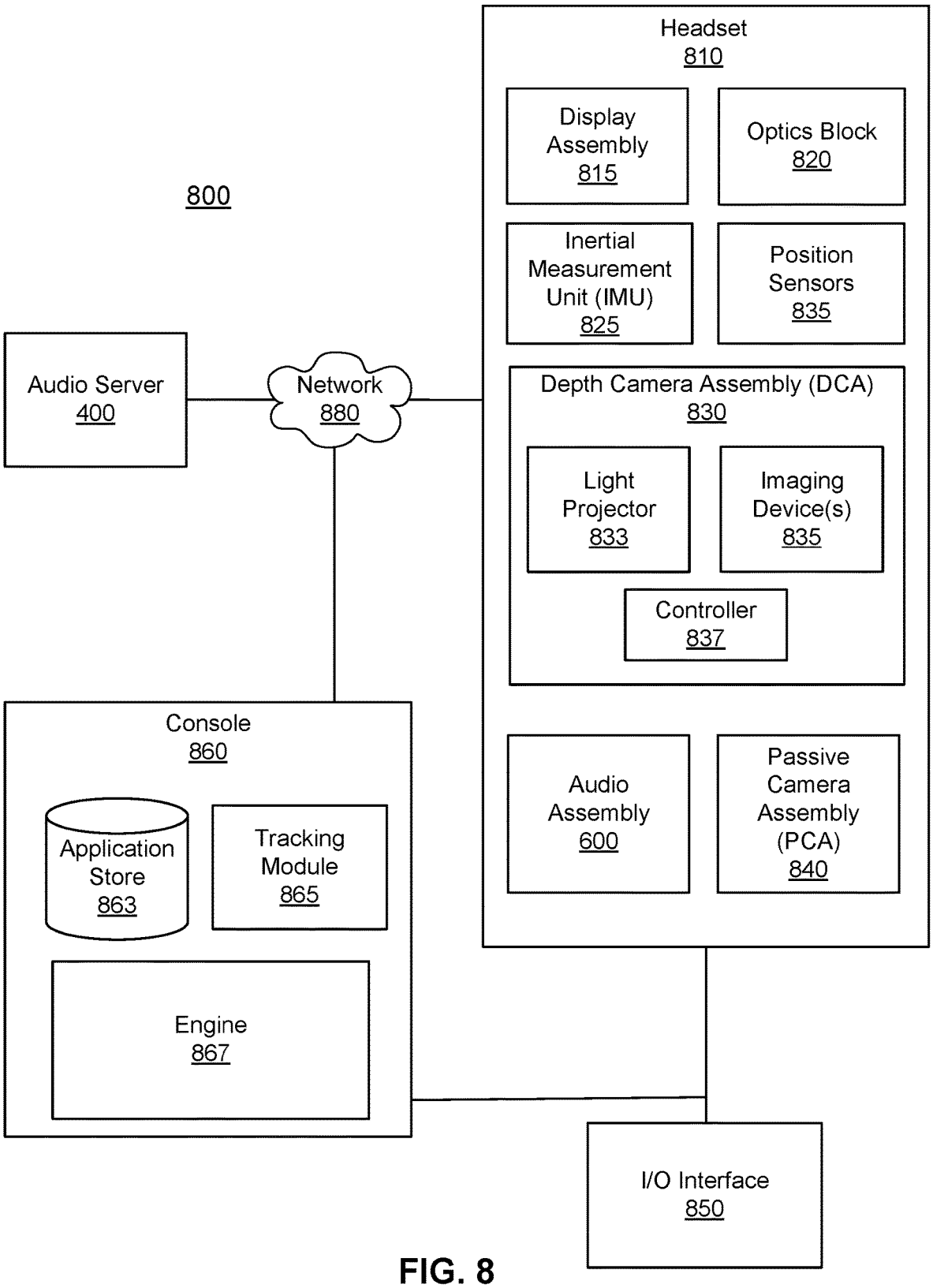
FIG. 8 is a block diagram of a system environment that includes a headset and an audio server, in accordance with one or more embodiments.

FIG. 8 is a block diagram of a system environment 800 that includes a headset 810 and an audio server 400, in accordance with one or more embodiments. The system 800 may operate in an artificial reality environment, e.g., a virtual reality, an augmented reality, a mixed reality environment, or some combination thereof. The system 800 shown by FIG. 8 includes a headset 810, an audio server 400 and an input/output (I/O) interface 840 that is coupled to a console 860. The headset 810, audio server 400, and console 860 communicate through network 880. While FIG. 8 shows an example system 800 including one headset 810 and one I/O interface 850, in other embodiments any number of these components may be included in the system 800. For example, there may be multiple headsets 810 each having an associated I/O interface 850, with each headset 810 and I/O interface 850 communicating with the console 860. In alternative configurations, different and/or additional components may be included in the system 800. Additionally, functionality described in conjunction with one or more of the components shown in FIG. 8 may be distributed among the components in a different manner than described in conjunction with FIG. 8 in some embodiments. For example, some or all of the functionality of the console 860 may be provided by the headset 810.

The headset 810 includes a display assembly 815, an optics block 820, one or more position sensors 835, the DCA 830, an inertial measurement unit (IMU) 825, the PCA 840, and the audio assembly 600. Some embodiments of headset 810 have different components than those described in conjunction with FIG. 8. Additionally, the functionality provided by various components described in conjunction with FIG. 8 may be differently distributed among the components of the headset 810 in other embodiments, or be captured in separate assemblies remote from the headset 810. An embodiment of the headset 810 is the headset 310 in FIG. 3 or the headset 900 in FIG. 9.

The display assembly 815 may include an electronic display that displays 2D or 3D images to the user in accordance with data received from the console 860. The images may include images of the local area of the user, images of virtual objects that are combined with light from the local area, images of a virtual area, or some combination thereof. The virtual area may be mapped a real room that is distant from the user. In various embodiments, the display assembly 815 comprises a single electronic display or multiple electronic displays (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof.

The optics block 820 magnifies image light received from the electronic display, corrects optical errors associated with the image light, and presents the corrected image light to a user of the headset 810. In various embodiments, the optics block 820 includes one or more optical elements. Example optical elements included in the optics block 820 include: an aperture, a Fresnel lens, a convex lens, a concave lens, a filter, a reflecting surface, or any other suitable optical element that affects image light. Moreover, the optics block 820 may include combinations of different optical elements. In some embodiments, one or more of the optical elements in the optics block 820 may have one or more coatings, such as partially reflective or anti-reflective coatings.

Magnification and focusing of the image light by the optics block 820 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 820 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 820 corrects the distortion after it receives image light from the electronic display generated based on the content.

The IMU 825 is an electronic device that generates data indicating a position of the headset 810 based on measurement signals received from one or more of the position sensors 835. A position sensor 835 generates one or more measurement signals in response to motion of the headset 810. Examples of position sensors 835 include: one or more accelerometers, one or more gyroscopes, one or more magnetometers, another suitable type of sensor that detects motion, a type of sensor used for error correction of the IMU 825, or some combination thereof. The position sensors 835 may be located external to the IMU 825, internal to the IMU 825, or some combination thereof.

The DCA 830 generates depth image data of a target area, such as a room. Depth image data includes pixel values defining distance from the imaging device, and thus provides a (e.g., 3D) mapping of locations captured in the depth image data. The DCA 830 in FIG. 8 includes a light projector 833, one or more imaging devices 825, and a controller 830. In some other embodiments, the DCA 830 includes a set of cameras that image in stereo.

The light projector 833 may project a structured light pattern or other light (e.g., infrared flash for time-of flight) that is reflected off objects in the target area, and captured by the imaging device 835 to generate the depth image data. For example, the light projector 833 may project a plurality of structured light (SL) elements of different types (e.g. lines, grids, or dots) onto a portion of a target area surrounding the headset 810. In various embodiments, the light projector 833 comprises an emitter and a diffractive optical element. The emitter is configured to illuminate the diffractive optical element with light (e.g., infrared light). The illuminated diffractive optical element projects a SL pattern comprising a plurality of SL elements into the target area. For example, each of the SL elements projected by the illuminated diffractive optical element is a dot associated with a particular location on the diffractive optical element.

The SL pattern projected into the target area by the DCA 830 deforms as it encounters various surfaces and objects in the target area. The one or more imaging devices 825 are each configured to capture one or more images of the target area. Each of the one or more images captured may include a plurality of SL elements (e.g., dots) projected by the light projector 833 and reflected by the objects in the target area. Each of the one or more imaging devices 825 may be a detector array, a camera, or a video camera.

In some embodiments, the light projector 833 projects light pulses that are reflected off of objects in the local area, and captured by the imaging device 835 to generate the depth image data by using time-of-flight techniques. For example, the light projector 833 projects infrared flash for time-of-flight. The imaging device 835 captures the infrared flash reflected by the objects. The controller 837 can use image data from the imaging device 835 to determine distances to the objects. The controller 837 may provide instructions to the imaging device 835 so that the imaging device 835 captures the reflected light pulses in synchronization with the projection of the light pulses by the light projector 833.

The controller 837 generates the depth image data based on light captured by the imaging device 835. The controller 837 may further provide the depth image data to the console 860, the audio controller 420, or some other component.

The PCA 840 includes one or more passive cameras that generate color (e.g., RGB) image data. Unlike the DCA 830 that uses active light emission and reflection, the PCA 840 captures light from the environment of a target area to generate image data. Rather than pixel values defining depth or distance from the imaging device, the pixel values of the image data may define the visible color of objects captured in the imaging data. In some embodiments, the PCA 840 includes a controller that generates the color image data based on light captured by the passive imaging device. In some embodiments, the DCA 830 and the PCA 840 share a common controller. For example, the common controller may map each of the one or more images captured in the visible spectrum (e.g., image data) and in the infrared spectrum (e.g., depth image data) to each other. In one or more embodiments, the common controller is configured to, additionally or alternatively, provide the one or more images of the target area to the audio controller or the console 860.

The audio assembly 600 presents audio content to a user of the headset 810 using an acoustic filter to incorporate local effects of room modes into the audio content. In some embodiments, the audio assembly 600 sends a room mode query to the audio server 400 to request room mode parameters describing the acoustic filter. The room mode query includes virtual information of the target area, location information of a user, information of the audio content, or some combination thereof. The audio assembly 600 receives the room mode parameters from the audio server 400 through the network 880. The audio assembly 600 uses the room mode parameters to generate a series of filters (e.g., infinite impulse response filters, all-pass filters, etc.) to render the audio content. The filters have Q value and gain at modal frequencies and simulate acoustic distortion at a position of the user within the target area. The audio content is spatialized and, when presented, appears originating from an object (e.g., virtual object or real object) within the target area and being received at the position of the user within the target area.

In one embodiment, the target area is at least a portion of the local area of the user, and the spatialized audio content may appear to originate from a virtual object in the local area. In another embodiment, the target area is a virtual area. For instance, the user is in a small office but the target area is a large virtual conference room where a virtual speaker gives a speech. The virtual conference room has different acoustics properties, such as room modes, from the small office. The audio assembly 600 presents the speech to the user as if it originates from the virtual speaker in the virtual conference room (i.e., uses room modes of a conference room as if it were a real location and does not use the room modes of the small office).

The audio server 400 determines one or more room mode parameters of the target area based on information in the room mode query from the audio assembly 600. In some embodiments, the audio server 400 determines a model of the target area based on a 3D representation of the target area. The 3D representation of the target area can be determined based on information in the room mode query, such as visual information of the target area and/or location information of the user that indicates a position of the user within the target area. The audio server 400 compares the 3D representation with candidate models and selects the candidate model that matches the 3D representation as the model of the target area. The audio server 400 determines room modes of the target area using the mode, such as based on a shape and/or dimensions of the model. The room modes can be represented by amplification as a function of frequency and position. Based on at least one of the room modes and the position of the user in the target area, the audio server 400 determines the one or more room mode parameters.

In some embodiments, the audio assembly 600 has some or all of the functionality of the audio server 400. The audio assembly 600 of the headset 810 and the audio server 400 may communicate via a wired or wireless communication link (e.g., the network 880).

The I/O interface 850 is a device that allows a user to send action requests and receive responses from the console 860. An action request is a request to perform a particular action. For example, an action request may be an instruction to start or end capture of image or video data, or an instruction to perform a particular action within an application. The I/O interface 850 may include one or more input devices. Example input devices include: a keyboard, a mouse, a game controller, or any other suitable device for receiving action requests and communicating the action requests to the console 860. An action request received by the I/O interface 850 is communicated to the console 860, which performs an action corresponding to the action request. In some embodiments, the I/O interface 850 includes the IMU 825, as further described above, that captures calibration data indicating an estimated position of the I/O interface 850 relative to an initial position of the I/O interface 850. In some embodiments, the I/O interface 850 may provide haptic feedback to the user in accordance with instructions received from the console 860. For example, haptic feedback is provided after an action request is received, or the console 860 communicates instructions to the I/O interface 850 causing the I/O interface 850 to generate haptic feedback after the console 860 performs an action.

The console 860 provides content to the headset 810 for processing in accordance with information received from one or more of: the DCA 830, the PCA 840, the headset 810, and the I/O interface 850. In the example shown in FIG. 8, the console 860 includes an application store 863, a tracking module 865, and an engine 867. Some embodiments of the console 860 have different modules or components than those described in conjunction with FIG. 8. Similarly, the functions further described below may be distributed among components of the console 860 in a different manner than described in conjunction with FIG. 8. In some embodiments, the functionality discussed herein with respect to the console 860 may be implemented in the headset 810, or a remote system.

The application store 863 stores one or more applications for execution by the console 860. An application is a group of instructions, that when executed by a processor, generates content for presentation to the user. Content generated by an application may be in response to inputs received from the user via movement of the headset 810 or the I/O interface 850. Examples of applications include: gaming applications, conferencing applications, video playback applications, or other suitable applications.

The tracking module 865 calibrates the local area of the system 800 using one or more calibration parameters and may adjust one or more calibration parameters to reduce error in determination of the position of the headset 810 or of the I/O interface 850. For example, the tracking module 865 communicates a calibration parameter to the DCA 830 to adjust the focus of the DCA 830 to more accurately determine positions of SL elements captured by the DCA 830. Calibration performed by the tracking module 865 also accounts for information received from the IMU 825 in the headset 810 and/or an IMU 825 included in the I/O interface 850. Additionally, if tracking of the headset 810 is lost (e.g., the DCA 830 loses line of sight of at least a threshold number of the projected SL elements), the tracking module 865 may re-calibrate some or all of the system 800.

The tracking module 865 tracks movements of the headset 810 or of the I/O interface 850 using information from the DCA 830, the PCA 840, the one or more position sensors 835, the IMU 825 or some combination thereof. For example, the tracking module 865 determines a position of a reference point of the headset 810 in a mapping of a local area based on information from the headset 810. The tracking module 865 may also determine positions of an object (real object or virtual object) in the local area or a virtual area. Additionally, in some embodiments, the tracking module 865 may use portions of data indicating a position of the headset 810 from the IMU 825 as well as representations of the local area from the DCA 830 to predict a future location of the headset 810. The tracking module 865 provides the estimated or predicted future position of the headset 810 or the I/O interface 850 to the engine 867.

The engine 867 executes applications and receives position information, acceleration information, velocity information, predicted future positions, or some combination thereof, of the headset 810 from the tracking module 865. Based on the received information, the engine 867 determines content to provide to the headset 810 for presentation to the user. For example, if the received information indicates that the user is at a position of a target area, the engine 867 generates virtual content (e.g., images and audio) associated with the target area. The target area may be a virtual area, e.g., a virtual conference room. The engine 867 can generate images of the virtual conference room and speeches given in the virtual conference room for the headset 810 to display to the user. The target area may be a local area of the user. The engine 867 can generate images of virtual objects combined with real objects from the local area and audio content associated with a virtual object or a real object. As another example, if the received information indicates that the user has looked to the left, the engine 867 generates content for the headset 810 that mirrors the user's movement in a virtual target area or in a target area augmenting the target area with additional content. Additionally, the engine 867 performs an action within an application executing on the console 860 in response to an action request received from the I/O interface 850 and provides feedback to the user that the action was performed. The provided feedback may be visual or audible feedback via the headset 810 or haptic feedback via the I/O interface 850.

Figure 9:
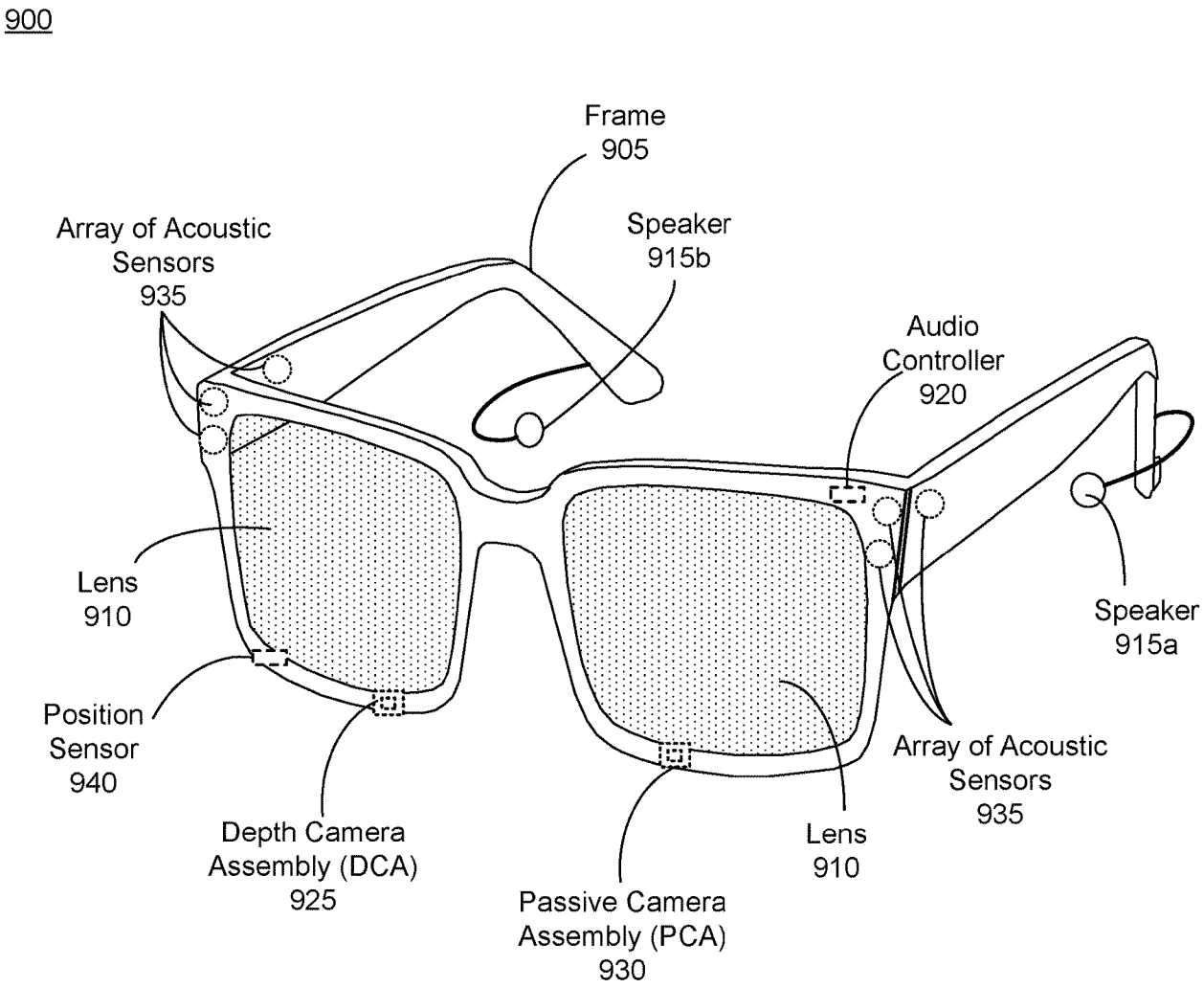
FIG. 9 is a perspective view of a headset including an audio assembly, in accordance with one or more embodiments.

FIG. 9 is a perspective view of a headset 900 including an audio assembly, in accordance with one or more embodiments. The headset 900 may be an embodiment of the headset 330 in FIG. 3 or the headset 810 in FIG. 8. In some embodiments (as shown in FIG. 9), the headset 900 is implemented as a NED. In alternate embodiments (not shown in FIG. 9), the headset 900 is implemented as an HMD. In general, the headset 900 may be worn on the face of a user such that content (e.g., media content) is presented using one or both lenses 910 of the headset 900. However, the headset 900 may also be used such that media content is presented to a user in a different manner. Examples of media content presented by the headset 900 include one or more images, video, audio, or some combination thereof. The headset 900 may include, among other components, a frame 905, a lens 910, a DCA 925, a PCA 930, a position sensor 940, and an audio assembly. The DCA 925 and the PCA 930 may be part of SLAM sensors mounted the headset 900 for capturing visual information of a target area surrounding some or all of the headset 900. While FIG. 9 illustrates the components of the headset 900 in example locations on the headset 900, the components may be located elsewhere on the headset 900, on a peripheral device paired with the headset 900, or some combination thereof.

The headset 900 may correct or enhance the vision of a user, protect the eye of a user, or provide images to a user. The headset 900 may be eyeglasses which correct for defects in a user's eyesight. The headset 900 may be sunglasses which protect a user's eye from the sun. The headset 900 may be safety glasses which protect a user's eye from impact. The headset 900 may be a night vision device or infrared goggles to enhance a user's vision at night. The headset 900 may be a near-eye display that produces artificial reality content for the user. Alternatively, the headset 900 may not include a lens 910 and may be a frame 905 with an audio assembly that provides audio content (e.g., music, radio, podcasts) to a user.

The frame 905 holds the other components of the headset 900. The frame 905 includes a front part that holds the lens 910 and end pieces to attach to a head of the user. The front part of the frame 905 bridges the top of a nose of the user. The end pieces (e.g., temples) are portions of the frame 905 to which the temples of a user are attached. The length of the end piece may be adjustable (e.g., adjustable temple length) to fit different users. The end piece may also include a portion that curls behind the ear of the user (e.g., temple tip, ear piece).

The lenses 910 provides or transmits light to a user wearing the headset 900. The lenses 910 may include a prescription lens (e.g., single vision, bifocal and trifocal, or progressive) to help correct for defects in a user's eyesight. The prescription lens transmits ambient light to the user wearing the headset 900. The transmitted ambient light may be altered by the prescription lens to correct for defects in the user's eyesight. The lenses 910 may include a polarized lens or a tinted lens to protect the user's eyes from the sun. The lenses 910 may include one or more waveguides as part of a waveguide display in which image light is coupled through an end or edge of the waveguide to the eye of the user. The lenses 910 may include an electronic display for providing image light and may also include an optics block for magnifying image light from the electronic display. The lenses 910 can be an embodiment of a combination of the display assembly 815 and optics block 820.

The DCA 925 captures depth image data describing depth information for a local area surrounding the headset 330, such as a room. The DCA 925 may be an embodiment of the DCA 830. In some embodiments, the DCA 925 may include a light projector (e.g., structured light and/or flash illumination for time-of-flight), an imaging device, and a controller (not shown in FIG. 9). The captured data may be images captured by the imaging device of light projected onto the local area by the light projector. In one embodiment, the DCA 925 may include a controller and two or more cameras that are oriented to capture portions of the local area in stereo. The captured data may be images captured by the two or more cameras of the local area in stereo. The controller of the DCA 925 computes the depth information of the local area using the captured data and depth determination techniques (e.g., structured light, time-of-flight, stereo imaging, etc.). Based on the depth information, the controller of the DCA 925 determines absolute positional information of the headset 330 within the local area. The DCA 925 may be integrated with the headset 330 or may be positioned within the local area external to the headset 330. In some embodiments, the controller of the DCA 925 may transmit the depth image data to the audio controller 920 of the headset 330, e.g. for further processing and communication to the audio server 400.

The PCA 930 includes one or more passive cameras that generate color (e.g., RGB) image data. The PCA 930 may be an embodiment of the PCA 840. Unlike the DCA 925 that uses active light emission and reflection, the PCA 930 captures light from the environment of a local area to generate color image data. Rather than pixel values defining depth or distance from the imaging device, pixel values of the color image data may define visible colors of objects captured in the image data. In some embodiments, the PCA 930 includes a controller that generates the color image data based on light captured by the passive imaging device. The PCA 930 may provide the color image data to the audio controller 920, e.g., for further processing and communication to the audio server 400.

In some embodiments, the DCA 925 and PCA 930 are the same camera assembly, such as a color camera system that uses stereo imaging for generating depth information.

The position sensor 940 generates location information of the headset 900 based on one or more measurement signals in response to motion of the headset 9010. The position sensor 940 may be an embodiment of one of the position sensors 835. The position sensor 940 may be located on a portion of the frame 905 of the headset 900. The position sensor 940 may include a position sensor, an IMU, or both. Some embodiments of the headset 900 may or may not include the position sensor 940 or may include more than one position sensors 940. In embodiments in which the position sensor 940 includes an IMU, the IMU generates IMU data based on measurement signals from the position sensor 940. Examples of position sensor 940 include: one or more accelerometers, one or more gyroscopes, one or more magnetometers, another suitable type of sensor that detects motion, a type of sensor used for error correction of the IMU, or some combination thereof. The position sensor 940 may be located external to the IMU, internal to the IMU, or some combination thereof.

Based on the one or more measurement signals, the position sensor 940 estimates a current position of the headset 900 relative to an initial position of the headset 900. The estimated position may include a location of the headset 900 and/or an orientation of the headset 900 or the user's head wearing the headset 900, or some combination thereof. The orientation may correspond to a position of each ear relative to a reference point. In some embodiments, the position sensor 940 uses the depth information and/or the absolute positional information from the DCA 925 to estimate the current position of the headset 900. The position sensor 940 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 900 from the sampled data.

For example, the IMU integrates the measurement signals received from the accelerometers over time to estimate a velocity vector and integrates the velocity vector over time to determine an estimated position of a reference point on the headset 900. The reference point is a point that may be used to describe the position of the headset 900. While the reference point may generally be defined as a point in area, however, in practice the reference point is defined as a point within the headset 900.

The audio assembly renders audio content to incorporate local effects of room modes. The audio assembly of the headset 900 is an embodiment of the audio assembly 600 described above in conjunction with FIG. 6. In some embodiments, the audio assembly sends a query to an audio server (e.g., the audio server 400) for an acoustic filter. The audio assembly receives room mode parameters from the audio server and generates an acoustic filter to present the audio content. The acoustic filter can include infinite impulse response filters and/or all-pass filters that have Q value and gain at modal frequencies of the room modes. In some embodiments, the audio assembly includes the speakers 915*a* and 915*b*, an array of acoustic sensors 935, and the audio controller 920.

The speakers 915*a* and 915*b* produce sound for user's ears. The speakers 915*a*, 915*b* are embodiments of transducers of the speaker assembly 610 in FIG. 6. The speakers 915*a* and 915*b* receive audio instructions from the audio controller 920 to generate sounds. The speaker 915*a* may obtains a left audio channel from the audio controller 920, and the speaker 915*b* obtains and a right audio channel from the audio controller 920. As illustrated in FIG. 9, each speaker 915*a*, 915*b* is coupled to an end piece of the frame 905 and is placed in front of an entrance to the corresponding ear of the user. Although the speakers 915*a* and 915*b* are shown exterior to the frame 905, the speakers 915*a* and 915*b* may be enclosed in the frame 905. In some embodiments, instead of individual speakers 915*a* and 915*b* for each ear, the headset 330 includes a speaker array (not shown in FIG. 9) integrated into, e.g., end pieces of the frame 905 to improve directionality of presented audio content.

The array of acoustic sensors 935 monitors and records sound in a local area surrounding some or all of the headset 330. The array of acoustic sensors 935 is an embodiment of the microphone assembly 620 of FIG. 6. As illustrated in FIG. 9, the array of acoustic sensors 935 include multiple acoustic sensors with multiple acoustic detection locations that are positioned on the headset 330.

The audio controller 920 requests one or more room mode parameters from an audio server (e.g., the audio server 400) by sending a room mode query to the audio server. The room mode query includes target area information, user information, audio content information, some other information that the audio server 320 can use to determine the acoustic filter, or some combination thereof. In some embodiments, the audio controller 920 generates the room mode query based on information from a console (e.g., the console 860) connected to the headset 900. The audio server 920 may generate the visual information describing at least a portion of the target area based on images of the target area. In some embodiments, the audio controller 920 generates the room mode query based on information from other components of the headset 900. For example, the visual information describing at least a portion of the target area may include depth image data captured by the DCA 925 and/or color image data captured by the PCA 930. The location information of the user may be determined by the position sensor 940.

The audio controller 920 generates an acoustic filter based on the room mode parameters received from the audio server. The audio controller 920 provides audio instructions to the speakers 915*a*, 915*b* for generating sound by using the acoustic filter such that local effects of room modes of a target area is incorporated into the sound. The audio controller 920 may be an embodiment of the audio controller 630 of FIG. 6.

In one embodiment, the communication module (e.g., a transceiver) may be integrated into the audio controller 920. In another embodiment, the communication module may be external to the audio controller 920 and integrated into the frame 905 as a separate module coupled to the audio controller 920.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

determining a model of a target area based in part on a three-dimensional virtual representation of the target area, the three-dimensional virtual representation of the target area generated by using depth information of at least a portion of the target area;

determining room modes of the target area using the model; and determining one or more room mode parameters based on at least one of the room modes and a position of a user within the target area, wherein the one or more room mode parameters describe an acoustic filter that is used by a headset to present audio content to the user and the acoustic filter, as applied to audio content, simulates acoustic distortion at the position of the user and at frequencies associated with the at least one room mode.

2. The method of claim 1, further comprising:

receiving, from the headset, the depth information.

3. The method of claim 1, wherein determining the model of the target area based in part on the three-dimensional virtual representation of the target area comprises:

comparing the three-dimensional virtual representation with a plurality of candidate models; and identifying one of the plurality of candidate models that matches the three-dimensional virtual representation as the model of the target area.

4. The method of claim 1, further comprising:

receiving color image data of at least a portion of the target area;

determining material composition of surfaces in the portion of the target area using the color image data;

determining an attenuation parameter for each surface based on the material composition of the surface; and updating the model with the attenuation parameter of each surface.

5. The method of claim 1, wherein determining the room modes of the target area using the model further comprises:

determining the room modes based on a shape of the model.

6. The method of claim 1, wherein the acoustic distortion describes amplification as a function of frequency.

7. The method of claim 1, further comprising:

transmitting parameters describing the acoustic filter to the headset for rendering the audio content at the headset.

8. The method of claim 1, wherein the target area is a virtual area.

9. The method of claim 8, wherein the virtual area is different from a physical environment of the user.

10. The method of claim 1, wherein the target area is a physical environment of the user.

11. The system of claim 10, wherein determining the room modes of the target area using the model comprises:

determining the room modes based on a shape of the model.

12. The system of claim 10, wherein the acoustic distortion describes amplification as a function of frequency.

13. The system of claim 10, wherein the steps further comprise:

transmitting parameters describing the acoustic filter to the headset for rendering the audio content at the headset.

14. A system, comprising:

a computer processor; and a non-transitory computer-readable storage medium storing executable computer program instructions, the computer program instructions comprising instructions that when executed cause the computer processor to perform steps, comprising:

determining a model of a target area based in part on a three-dimensional virtual representation of the target area, the three-dimensional virtual representation of the target area generated by using depth information of at least a portion of the target area;

determining room modes of the target area using the model; and determining one or more room mode parameters based on at least one room mode of the room modes and a position of a user within the target area, wherein the one or more room mode parameters describe an acoustic filter that is used by a headset to present audio content to the user and the acoustic filter, as applied to audio content, simulates acoustic distortion at the position of the user and at frequencies associated with the at least one room mode.

15. The system of claim 14, wherein determining the model of the target area based in part on the three-dimensional virtual representation of the target area comprises:

comparing the three-dimensional virtual representation with a plurality of candidate models; and identifying one of the plurality of candidate models that matches the three-dimensional virtual representation as the model of the target area.

16. A method comprising:

generate an acoustic filter based on one or more room mode parameters, the acoustic filter simulating acoustic distortion at a position of a user within a target area and at frequencies associated with at least one room mode of the target area, the room mode determined based in part on a three-dimensional virtual representation of the target area that is generated by using depth information of at least a portion of the target area; and presenting audio content to the user by using the acoustic filter, the audio content appearing originating from an object in the target area and being received at the position of the user within the target area.

17. The method of claim 16, wherein the acoustic filter comprises a plurality of infinite impulse response filters with Q value or gain at modal frequencies of the at least one room mode.

18. The method of claim 17, wherein the acoustic filter further comprises a plurality of all-pass filters with Q value or gain at modal frequencies of the at least one room mode.

19. The method of claim 16, further comprising:

sending a room mode query to an audio server, the room mode query comprising virtual information of the target area and location information of the user; and receiving the one or more room mode parameters from the audio server.

20. The method of claim 16, further comprising:

dynamically adjusting the acoustic filter based on the at least one room mode and changes in the position of the user.

* * * * *